US008157189B2

(12) United States Patent
Johnson et al.

(10) Patent No.: US 8,157,189 B2
(45) Date of Patent: Apr. 17, 2012

(54) PREMIXING DIRECT INJECTOR

(75) Inventors: Thomas Edward Johnson, Greer, SC (US); Christian Xavier Stevenson, Inman, SC (US); William David York, Greer, SC (US); Willy Steve Ziminsky, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 454 days.

(21) Appl. No.: 12/417,896

(22) Filed: Apr. 3, 2009

(65) Prior Publication Data

US 2010/0252652 A1 Oct. 7, 2010

(51) Int. Cl.
*B05B 15/00* (2006.01)

(52) U.S. Cl. ..... 239/132.5; 239/132.1; 239/423; 239/426; 239/431; 239/434; 239/562

(58) Field of Classification Search ..... 239/419, 239/423–424.5, 426, 427, 427.3, 429–431, 239/433–434, 499, 556, 557, 562, 132–132.5
See application file for complete search history.

(56) References Cited

U.S. PATENT DOCUMENTS

| | | | | |
|---|---|---|---|---|
| 4,100,733 | A | 7/1978 | Striebel et al. | |
| 4,966,001 | A | 10/1990 | Beebe | |
| 5,170,942 | A * | 12/1992 | Spink et al. | 239/427.3 |
| 5,263,325 | A | 11/1993 | McVey et al. | |
| 5,904,477 | A | 5/1999 | Van Dam et al. | |
| 6,267,585 | B1 | 7/2001 | Suttrop | |
| 2010/0031662 | A1 | 2/2010 | Zuo | |
| 2010/0186413 | A1 | 7/2010 | Lacy et al. | |

* cited by examiner

*Primary Examiner* — Christopher Kim
(74) *Attorney, Agent, or Firm* — Cantor Colburn LLP

(57) ABSTRACT

A fuel injection nozzle comprises a body member having an upstream wall opposing a downstream wall, a baffle member having an upstream surface and a downstream surface, a first chamber, a second chamber, a fuel inlet communicative with the first chamber operative to emit a first gas into the first chamber, and a plurality of mixing tubes, each of the mixing tubes having a tube inner surface, a tube outer surface, a first inlet communicative with an aperture in the upstream wall operative to receive a second gas, a second inlet communicative with the tube outer surface and the tube inner surface operative to translate the first gas into the mixing tube, a mixing portion operative to mix the first gas and the second gas, and an outlet communicative with an aperture in the downstream wall operative to emit the mixed first and second gasses.

15 Claims, 3 Drawing Sheets

PREMIXING DIRECT INJECTOR

FEDERAL RESEARCH STATEMENT

This invention was made with Government support under Government Contract #DE-FC26-05NT42643 awarded by Department of Energy. The Government has certain rights in this invention.

BACKGROUND OF THE INVENTION

The subject matter disclosed herein relates to fuel injectors for turbine engines.

Turbine engines such as, for example, gas turbine engines may operate using a number of different types of fuels. The use of natural gas to power turbine engines has led to a reduction in the emissions of turbine engines and increased efficiency. Other fuels, such as, for example hydrogen (H2) and mixtures of hydrogen and nitrogen offer further reductions of emissions and greater efficiency.

Hydrogen fuels often have a higher reactivity than natural gas fuels, causing hydrogen fuel to combust more easily. Thus, fuel nozzles designed for use with natural gas fuels may not be fully compatible for use with fuels having a higher reactivity.

BRIEF DESCRIPTION OF THE INVENTION

According to one aspect of the invention, a fuel injection nozzle comprises a body member having an upstream wall opposing a downstream wall, a baffle member disposed in the body member having an upstream surface and a downstream surface, a first chamber partially defined by the downstream surface of the baffle member and an inner surface of the downstream wall, a second chamber communicative with the first chamber, partially defined by the upstream surface of the baffle member and an inner surface of the upstream wall, a fuel inlet communicative with the first chamber operative to emit a first gas into the first chamber, and a plurality of mixing tubes, each of the mixing tubes having a tube inner surface, a tube outer surface, a first inlet communicative with an aperture in the upstream wall operative to receive a second gas, a second inlet communicative with the tube outer surface and the tube inner surface operative to translate the first gas into the mixing tube, a mixing portion operative to mix the first gas and the second gas, and an outlet communicative with an aperture in the downstream wall operative to emit the mixed first and second gasses.

According to another aspect of the invention, a fuel injection nozzle comprises a body member having an upstream wall opposing a downstream wall, a chamber partially defined by the upstream wall and the downstream wall, a fuel inlet communicative with the chamber operative to emit a first gas into the chamber, a plurality of mixing tubes, each of the mixing tubes having a tube inner surface, a tube outer surface, a first inlet communicative with an aperture in the upstream wall operative to receive a second gas, a second inlet communicative with the tube outer surface and the tube inner surface operative to translate the first gas into the mixing tube, a mixing portion operative to mix the first gas and the second gas, and an outlet communicative with an aperture in the downstream wall operative to emit the mixed first and second gasses, and a cooling feature disposed on the tube outer surface operative to exchange heat between the tube outer surface and the first gas.

According to yet another aspect of the invention, a fuel injection system comprises a first air cavity, a second air cavity, a fuel injection nozzle comprising, a body member having an upstream wall opposing a downstream wall, a baffle member disposed in the body member having an upstream surface and a downstream surface, a first chamber partially defined by the downstream surface of the baffle member and an inner surface of the downstream wall, a second chamber communicative with the first chamber, partially defined by the upstream surface of the baffle member and an inner surface of the upstream wall, a fuel inlet communicative with the first chamber and the first air cavity operative to emit a first gas into the first chamber, and a plurality of mixing tubes, each of the mixing tubes having a tube inner surface, a tube outer surface, a first inlet communicative with an aperture in the upstream wall and the second air cavity operative to receive a second gas, a second inlet communicative with the tube outer surface and the tube inner surface operative to translate the first gas into the mixing tube, a mixing portion operative to mix the first gas and the second gas, and an outlet communicative with an aperture in the downstream wall operative to emit the mixed first and second gasses.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Gas turbine engines may operate using a variety of fuels. The use of natural gas, for example, offers savings in fuel cost and decreases carbon and other undesirable emissions. Some gas turbine engines inject the fuel into a combustor where the fuel mixes with an air stream and is ignited. One disadvantage of mixing the fuel and air in the combustor is that the mixture may not be uniformly mixed prior to combustion. The combustion of a non-uniform fuel air mixture may result in some portions of the mixture combusting at higher temperatures than other portions of the mixture. The higher temperatures are undesirable because the chemical reaction at the higher temperatures may result in the emission of undesirable pollutants.

One method for overcoming the non-uniform mixture of gasses in the combustor includes mixing the fuel and air prior to injecting the mixture into the combustor. The method is performed by, for example, a premixing direct injection (PDI) injector fuel nozzle. The use of a PDI injector nozzle to mix, for example, natural gas and air allows a uniform mixture of fuel and air to be injected into the combustor prior to ignition of the mixture. Hydrogen gas (H2) and mixtures of hydrogen and, for example, nitrogen gas used as fuel offer a further reduction in pollutants emitted from the gas turbine. In gas turbine engines, it is undesirable for combustion to occur in the injector, since the injector is designed to operate in temperatures below combustion temperatures. Rather, a PDI injector is intended to mix the relatively cool fuel and air, and emit the mixture into the combustor where the mixture is combusted.

Figure 1:
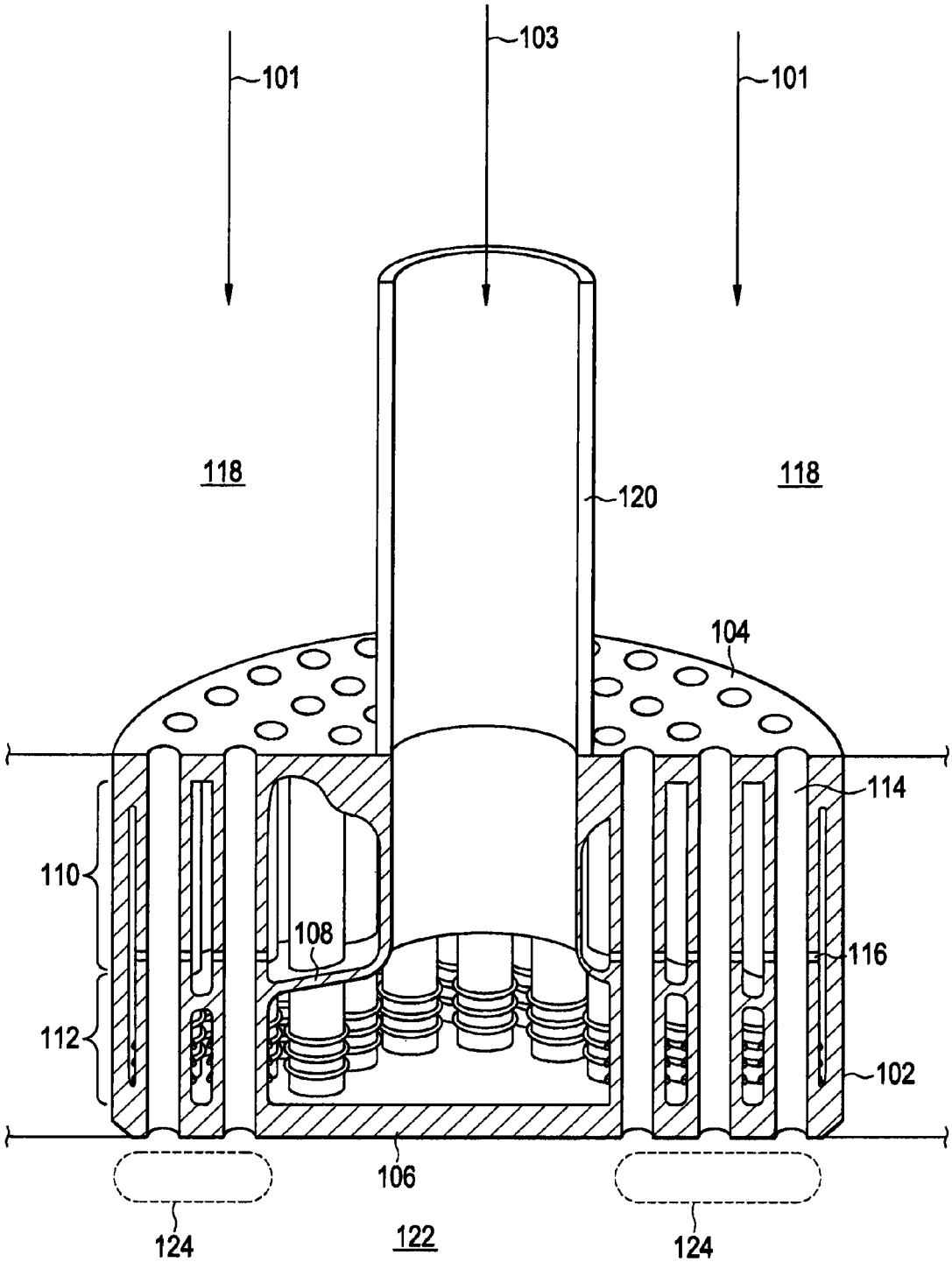
FIG. 1 is a perspective, partially cut-away view of an exemplary embodiment of a portion of a Premixing Direct Injector (PDI) injector nozzle.

FIG. 1 illustrates a perspective, partially cut-away view of an exemplary embodiment of a portion of a PDI injector nozzle 100 (injector). The injector 100 includes a body member 102 having an upstream wall 104 and a downstream wall 106. A baffle member 108 is disposed in the body member 102, and defines an upstream chamber 110 and a downstream chamber 112. A plurality of mixing tubes 114 is disposed in the body member 102. The mixing tubes 114 include inlets 116 communicative between the upstream chamber 110 and an inner surface of the mixing tubes 114.

In operation, air flows along a path indicated by the arrow 101 through a shroud 118. The air enters the mixing tubes 114 via apertures in the upstream wall 104. A fuel, such as, for example, hydrogen gas or a mixture of gasses flows along a path indicated by the arrow 103 through a fuel cavity 120. The fuel enters the body member 102 in the downstream chamber 112. The fuel flows radialy outward from the center of the down stream chamber 112 and into the upstream chamber 110. The fuel enters the inlets 116 and flows into the mixing tubes 114. The fuel and air mix in the mixing tubes 114 and are emitted as a fuel-air mixture from the mixing tubes into a combustor portion 122 of a turbine engine. The fuel-air mixture combusts in the flame regions 124 of the combustor portion 122.

Previous injectors did not transfer thermal energy away from the fuel-air mixture sufficiently to prevent the fuel-air mixture from igniting or burning inside the mixing tubes 114 during certain harsh conditions. An ignition of the fuel-air mixture in the mixing tubes 114 may severely damage the injector 100.

Figure 2:
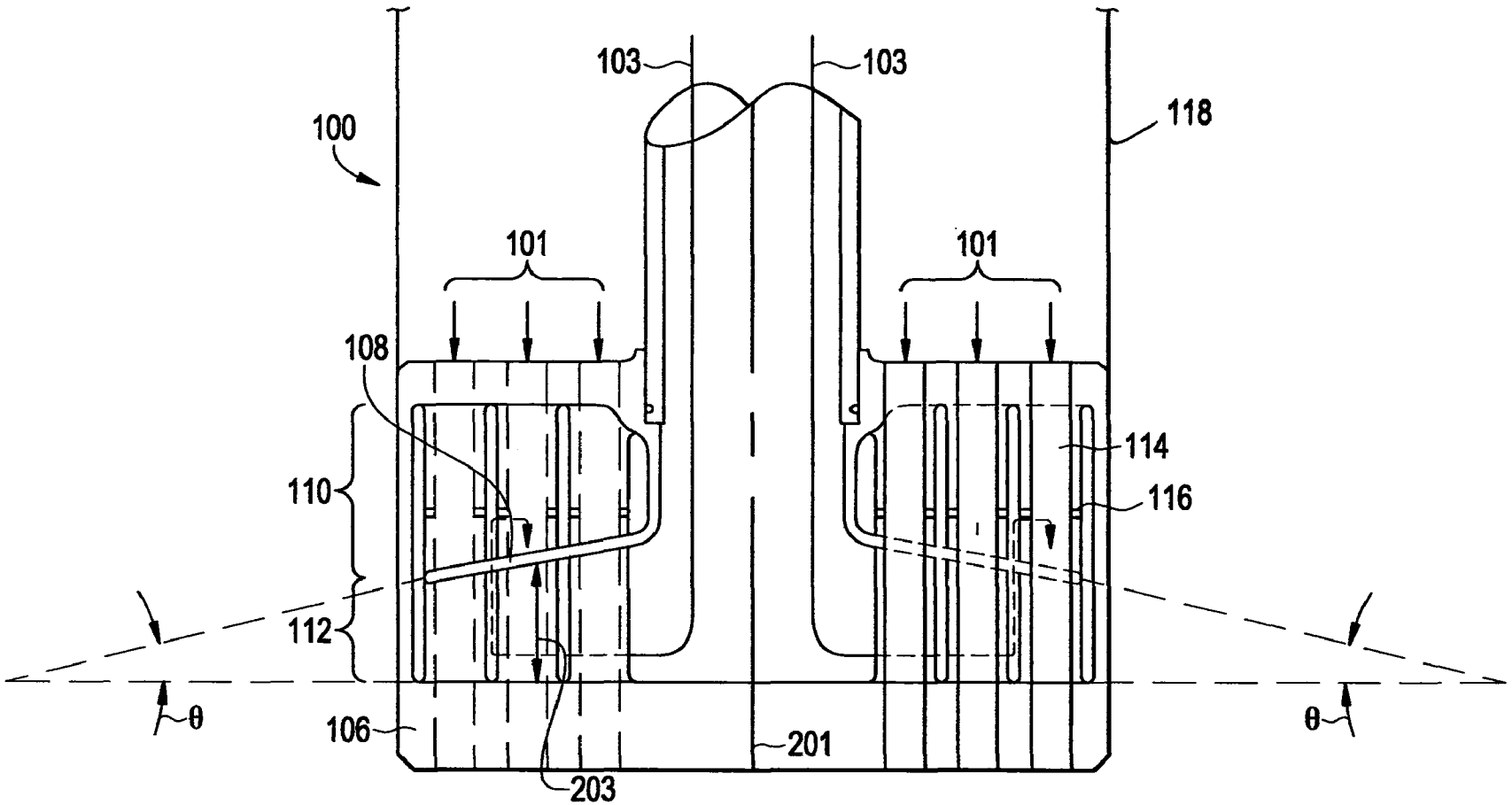
FIG. 2 is a side cut-away view of a portion of the PDI injector nozzle of FIG. 1.

FIG. 2 illustrates a side cut-away view of a portion of the injector 100, and will further illustrate the operation of the injector 100. The fuel flow is shown by the arrows 103. The fuel enters the downstream chamber 112 along a path parallel to the center axis 201 of the injector 100. When the fuel enters the downstream chamber 112, the fuel flows radialy outward from the center axis 201. The fuel flows into the upstream chamber 110 after passing an outer lip of the baffle member 108. The fuel flows through the upstream chamber 110, enters the inlets 116, and flows into the mixing tubes 114. The fuel-air mix is created in the mixing tubes 114, downstream from the inlets 116. The fuel is cooler than the air. The flow of the fuel around the surface of the mixing tubes 114 in the downstream chamber 112 cools the mixing tubes 114 and helps to prevent the ignition or sustained burning of the fuel-air mixture inside the mixing tubes 114.

To effectively cool the mixing tubes 114, the velocity of the fuel flow is maintained above a threshold level. As the fuel flow extends radialy outward in the downstream chamber 112, the surface area of the downstream wall 106 increases. Since the velocity of the fuel flow is influenced by the volume of the downstream chamber 112, the baffle member 108 that is disposed at an oblique angle to the down stream wall 106, the volume of the chamber increases as the fuel flow approaches the outer diameter of the downstream chamber 112—reducing the velocity of the fuel flow. The baffle member 108 is shown at an angle (Φ) relative to the downstream wall 106. The angle (Φ) of the baffle member 108 reduces the distance between the baffle member 108 and the downstream wall 106 (indicated by arrow 203) as the fuel flows radially outward in the downstream chamber 112. The reduction of the distance 203 in proportion to the increase in the surface area of the downstream wall 106 allows the volume of the downstream chamber 112 to be maintained below a threshold volume. Once a volume for the down stream chamber is determined, the angle (Φ) of the baffle member 108 may be geometrically calculated to effectively maintain the lower threshold velocity of the gas flow. The angle of the baffle member 108 also reduces the distance between the baffle member 108 and the upstream wall 104 as the fuel flows into the upstream chamber 110. The angle of the baffle member 108 helps to maintain a uniform pressure and velocity of the fuel flow in the upstream chamber 110.

Figure 3:
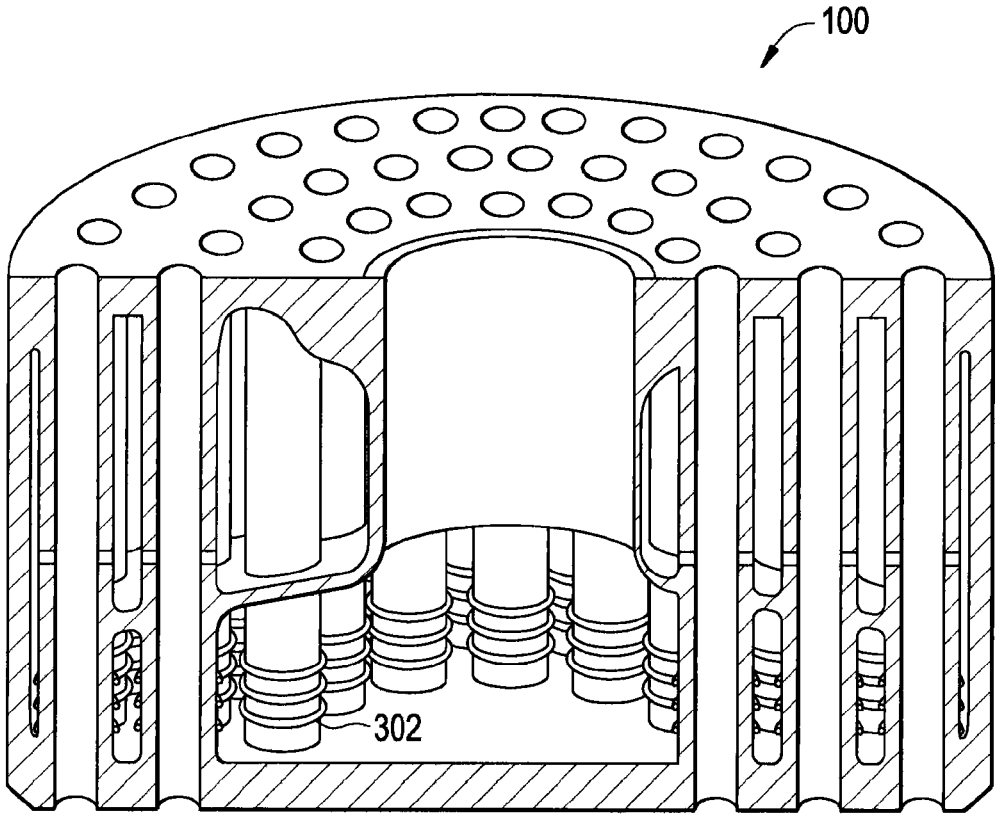
FIG. 3 is perspective, partially cut-away view of a portion of the PDI injector nozzle of FIG. 1.

FIG. 3 illustrates a perspective, partially cut-away view of a portion of the injector 100. The heat exchange between the fuel and the outer surface of the mixing tubes 114 may be improved by cooling features disposed on the outer surface of the mixing tubes 114. FIG. 3 shows an exemplary embodiment of cooling fins 302 connected to the mixing tubes 114. The cooling fins 302 increase the surface area of the outer surface of the mixing tubes 114 and improve the heat exchange between the fuel and the outer surface of the mixing tubes 114. The additional surface area, and/or a higher heat transfer coefficient effect the improvement in the heat exchange. FIG. 3 is an example of one embodiment of cooling features. Other embodiments may include, for example, a different number of cooling fins, dimples, ridges, fins at oblique angles, groves, channels, or other similar cooling features.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel injection nozzle comprising:

a body member having an upstream wall opposing a downstream wall;

a baffle member disposed in the body member having an upstream surface and a downstream surface;

a first chamber partially defined by the downstream surface of the baffle member and an inner surface of the downstream wall;

a second chamber communicative with the first chamber, partially defined by the upstream surface of the baffle member and an inner surface of the upstream wall;

a fuel inlet communicative with the first chamber operative to emit a first gas into the first chamber; and a plurality of mixing tubes, each of the mixing tubes having a tube inner surface, a tube outer surface, a first inlet communicative with an aperture in the upstream wall operative to receive a second gas, a second inlet disposed in the second chamber, the second inlet communicative with the tube outer surface and the tube inner surface operative to translate the first gas into the mixing tube, a mixing portion operative to mix the first gas and the second gas, and an outlet communicative with an aperture in the downstream wall operative to emit the mixed first and second gasses.

2. The fuel injection nozzle of claim 1, wherein the nozzle defines a fuel flow path defined by the fuel inlet, the first chamber, the second chamber, and the second inlet.

3. The fuel injection nozzle of claim 1, wherein each mixing tube defines an air flow path.

4. The fuel injection nozzle of claim 1, wherein the body member is tubular having a centered longitudinal axis parallel to a flow of the second gas.

5. The fuel injection nozzle of claim 1, wherein the baffle member is disposed in the body member at an oblique angle to the downstream wall.

6. The fuel injection nozzle of claim 1, wherein each mixing tube includes an upstream portion defined by the second chamber and a downstream portion defined by the first chamber.

7. The fuel injection nozzle of claim 6, wherein the second inlet is disposed in the upstream portion of each mixing tube.

8. The fuel injection nozzle of claim 1, wherein each tube outer surface includes a heat transfer feature disposed in the down stream portion of each mixing tube.

9. The fuel injection nozzle of claim 1, wherein the first gas is a fuel.

10. A fuel injection system comprising:

a fuel cavity;

a shroud cavity;

a fuel injection nozzle comprising, a body member having an upstream wall opposing a downstream wall, a baffle member disposed in the body member having an upstream surface and a downstream surface, a first chamber partially defined by the downstream surface of the baffle member and an inner surface of the downstream wall, a second chamber communicative with the first chamber, partially defined by the upstream surface of the baffle member and an inner surface of the upstream wall, a fuel inlet communicative with the first chamber and the fuel cavity operative to emit a first gas into the first chamber, and a plurality of mixing tubes, each of the mixing tubes having a tube inner surface, a tube outer surface, a first inlet communicative with an aperture in the upstream wall and the shroud cavity operative to receive a second gas, a second inlet disposed in the second chamber, the second inlet communicative with the tube outer surface and the tube inner surface operative to translate the first gas into the mixing tube, a mixing portion operative to mix the first gas and the second gas, and an outlet communicative with an aperture in the downstream wall operative to emit the mixed first and second gasses.

11. The system of claim 10, wherein the nozzle defines a fuel flow path defined by the fuel inlet, the first chamber, the second chamber, and the second inlet.

12. The system of claim 10, wherein the baffle member is disposed in the body member at an oblique angle to the downstream wall.

13. The system of claim 10, wherein each mixing tube includes an upstream portion defined by the second chamber and a downstream portion defined by the first chamber and the second inlet is disposed in the upstream portion of each mixing tube.

14. The system of claim 10, wherein each tube outer surface includes a heat transfer feature disposed in the downstream portion of each mixing tube.

15. The system of claim 10, wherein the baffle member is disposed in the body member at an oblique angle to the upstream wall.

* * * * *